US005538828A

United States Patent [19]

Suzuki et al.

[11] Patent Number: 5,538,828

[45] Date of Patent: Jul. 23, 1996

[54] TONER RESIN COMPOSITION AND TONER

[75] Inventors: Tatsuo Suzuki, Shiga-ken; Tsunehiro Masaoka, Takatsuki, both of Japan

[73] Assignee: Sekisui Chemical Co., Ltd., Tokyo, Japan

[21] Appl. No.: 503,490

[22] Filed: Jul. 18, 1995

Related U.S. Application Data

[62] Division of Ser. No. 335,256, Nov. 7, 1994.

[51] Int. Cl.[6] ..... G03G 9/097

[52] U.S. Cl. ..... 430/110; 430/111

[58] Field of Search ..... 430/110, 111

[56] References Cited

U.S. PATENT DOCUMENTS

| | | | |
|---|---|---|---|
| 4,246,332 | 1/1981 | Tanaka et al. | 430/110 X |
| 4,450,221 | 5/1984 | Terada et al. | 430/106.6 |
| 4,473,628 | 9/1984 | Kasuya et al. | 430/110 X |
| 5,001,031 | 3/1991 | Yamamoto et al. | 430/111 X |
| 5,366,839 | 11/1994 | Aoki | 430/110 X |

FOREIGN PATENT DOCUMENTS

| | | | |
|---|---|---|---|
| 156958 | 12/1980 | Japan | 430/111 |
| 37653 | 3/1983 | Japan | 430/110 |

*Primary Examiner*—Roland Martin

*Attorney, Agent, or Firm*—Townsend & Banta

[57] ABSTRACT

The present invention provides a toner resin composition and toner which is superior in terms of low temperature fixation and superior anti-offset, anti-aggregation and anti-smearing properties, by introducing in the binder which is primarily composed of vinyl copolymer, a vinyl copolymer which has, in its molecular weight distribution curve, at least a peak in the range of $1\times10^3$–$8\times10^4$, plus a peak or a shoulder in the range of $1\times10^5$–$4\times10^6$, or a Mw/Mn of 6 or more, or 5 wt % or more of a toluene nonsoluble component, and 1–50 wt % of a specific ethylene copolymer.

6 Claims, No Drawings

TONER RESIN COMPOSITION AND TONER

CROSS REFERENCE TO A RELATED APPLICATIONS

This is a divisional application of co-pending application Ser. No. 08/335,256 filed Nov. 7, 1994.

FIELD OF THE INVENTION

This invention relates in general to a toner resin and toner used in electrophotography, and more particularly to a toner resin composition and toner which are used in the so-called dry developing method in the electrostatic charge image development.

DESCRIPTION OF RELATED ART

A conventional electrophotography method utilizes a photoconductive material, using various means to form electrical latent images on a photosensitive matter, developing these latent images with toner, transferring the images to a transfer matter such as a sheet of paper if necessary, and fixing them with a heat source such as thermal rolls to form permanent visible images.

For toners, usually a system which is prepared by dispersing coloring materials such as dyes and pigments in a resin is electrified by friction with what is called a "carrier", e.g. iron, to use them as a two-component developing agent, or magnetic particles such as magnetite are dispersed and used as magnetic toner.

As the fixing method, the heated roller method is widely used, which is carried out by feeding the sheet through a heated roller(s) which has a toner-separating material formed on its surface, with the paper sheet surface on which the toner images are formed being compressed onto said roller surface.

In the heated roller method, in order to increase cost performance by reducing power consumption and also to increase the copying speed, there is demand for a toner resin which can be fixed at lower temperatures.

To increase the low temperature fixability, methods such as lowering the molecular weight of the vinyl copolymer have been proposed. However, although fixability of the toners is improved by these methods, there were problems including a phenomenon in which part of the image forming toner is transferred to the surface of the heated roller during fixation, and the toner is then transferred to the next paper sheet and contaminates the images (hereafter referred to as "the offset phenomenon"). Also the toner tended to aggregate.

To prevent these problems, techniques have been proposed of (1) composing a toner resin with a lower molecular weight polymer component and a higher molecular weight polymer component (Japanese unexamined patent publication (Tokkai) Sho 56-158340, Tokkai Sho 58-202455); (2) composing a toner-resin with a low molecular weight polymer component and a gel-state polymer component (Tokkai Hei 1-219764), and (3) of introducing polyolefin into a toner resin (Tokkai Hei 2-79860) have been proposed.

However, even these toners have not provided sufficient fixing characteristics, and because of low tenacity of the resins, the white areas with no toner were smeared into when the fixed paper was rubbed (smearing).

SUMMARY OF THE INVENTION

The present invention attempts to improve the shortcomings described above, and the object is to provide a toner resin composition and toner which:

1) is superior in terms of low temperature fixation;

2) has superior anti-offset properties;

3) has superior anti-aggregation properties; and 4) is free of smearing.

The object of the present invention is to solve the problems described above by providing a toner resin composition with a lower fixation temperature and superior anti-offset, anti-aggregation and anti-smearing properties, by introducing, in the binder for the toner primarily composed of vinyl copolymer, a vinyl copolymer which has, in its molecular weight distribution curve, at least a peak in the range of $1\times10^3$–$8\times10^4$, plus a peak or a shoulder in the range of $1\times10^5$–$4\times10^6$, or a Mw/Mn of 6 or more, or 5 wt % or more of the toluene nonsoluble component, and 1–50 wt % of a specific ethylene copolymer.

DETAILED DESCRIPTION OF THE INVENTION

For the vinyl copolymer used in the present invention, those which have styrene-type monomers, acrylic ester or methacrylic ester monomers as structural units are preferable. Specific examples of the styrene-type monomers in the present invention are: styrene, o-methylstyrene, m-methylstyrene, p-methylstyrene, alpha-methylstyrene, p-ethylstyrene, 2,4-dimethylstyrene, p-n-butylstyrene, p-tert-butylstyrene, p-n-hexylstyrene, p-n-octylstyrene, p-n-dodecylstyrene, p-methoxystyrene, p-phenylstyrene, p-chlorostyrene and 3,4-dichlorostyrene.

Specific examples of the acrylic ester and methacrylic ester monomers in the present invention are: alkyl esters of acrylic acid or methacrylic acid, such as methyl acrylate, ethyl acrylate, propyl acrylate, n-butyl acrylate, isobutyl acrylate, n-octyl acrylate, dodecyl acrylate, 2-ethylhexyl acrylate, stearyl acrylate, methyl methacrylate, ethyl methacrylate, propyl methacrylate, n-butyl methacrylate, isobutyl methacrylate, n-octyl methacrylate, dodecyl methacrylate and stearyl methacrylate; and also 2-chloroethyl acrylate, phenyl acrylate, methyl alpha-chloro acrylate, phenyl methacrylate, dimethylaminoethyl methacrylate, diethylaminoethyl methacrylate, 2-hydroxyethyl methacrylate, glycidyl methacrylate, bisglycidyl methacrylate, polyethyleneglycol dimethacrylate and methacryloxyethyl phosphate. More preferably used are ethyl acrylate, propyl acrylate, butyl acrylate, methyl methacrylate, ethyl methacrylate, propyl methacyrlate and butyl methacrylate.

Examples of other vinyl type monomers used in the present invention are: acrylic acid and its alpha- or beta-alkyl derivatives such as acrylic acid, methacrylic acid, alpha-ethyl acrylic acid and crotonic acid; unsaturated dicarbonic acids as well as their mono ester derivatives and diester derivatives such as fumaric acid, maleic acid, citraconic acid and itaconic acid; and also monoacryloyloxyethylester succinate, monomethacryloyloxyethylester succinate, acrylonitrile, methacrylonitrile and acrylamide.

Selection of the vinyl copolymer used in the present invention is not limited in particular as long as it is normally used as a toner resin, but, in its molecular weight distribution curve, it must have at least a peak in the range of $1\times10^3$–$8\times10^4$, plus a peak or a shoulder in the range of $1\times10^5$–$4\times10^6$, or a Mw/Mn of 6 or more, or 5 wt % or more of the toluene nonsoluble component.

If the peak value of the molecular weight distribution on the lower molecular weight side is lower than the range mentioned above, then the aggregation properties may deteriorate. On the other hand, if it is higher than the range mentioned above, then the fixability may become poor. A more preferable range is $3\times10^3$–$4\times10^4$.

If the peak value or the shoulder on the higher molecular weight side, the Mw/Mn or the toluene nonsoluble content is smaller than said range, the anti-offset properties may deteriorate. On the other hand, if the peak value or the shoulder on the higher molecular weight side is higher than the range mentioned above, then the fixability may become poor. More preferable is to have a peak or shoulder in the range of $1\times10^5$–$4\times10^6$, a Mw/Mn of 10 or more, or a toluene nonsoluble content of at least 15 wt %.

When there are two peaks, one for the lower molecular weight part and one for the higher molecular weight part in the molecular weight distribution curve, the anti-offset properties may become poor if the content of the higher molecular weight part is less than 15 wt %.

In view of aggregation properties, it is preferable for the polymer in the present invention to have a glass transition point of 50° C. or higher.

Selection of the ethylene-alpha olefin copolymer used in the present invention is not limited in particular as long as it is an alpha olefin copolymer containing ethylene. The ethylene content is preferably 50 mol % or more, and more preferably 70 mol % or more. If the amount of the other alpha olefin is too low, then the tendency to crystallize will become stronger and dispersibility with the vinyl copolymer may become poor. Therefore, the amount of the other alpha olefin is preferably 4 mol % or more.

The other usable alpha olefins include, propylene, butene, pentene, hexene, methylpentene, tetradecene, pentadecene, etc. Two or more types can be used as necessary. Alpha olefins of C7 or smaller are preferable, and butene is particularly preferable.

If the ethylene is highly blocked, then the tendency to crystallize increases and dispersibility with the vinyl copolymer may become poor. Therefore, the copolymer of ethylene and alpha olefin should preferably be close to random copolymerization.

If the molecular weight of the ethylene-alpha olefin copolymer is too low, the vinyl copolymer may be plasticized and the shelf life will be affected, the resin strength may decrease significantly and smearing will occur, and/or aggregation breakdown may occur to the fixed toner on the interface of that to which the toner is fixed. Therefore, the Mw (weight-average molecular weight) is preferably 1,000 or more, and more preferably 2,000 or more.

In view of the crushability of the resin and dispersibility with the vinyl resin, the Mn (number-average molecular weight) is preferably 80,000 or less, and more preferably 40,000 or less.

The viscosity of the ethylene-alpha olefin copolymer at 140° C. must be 10,000 poises or less. If it is more than this, then the viscosity is too high and the flowability at low temperatures will not be sufficient, making it impossible to fix at low temperatures. More preferable is 1,000 poises or less.

For the content of ethylene-alpha olefin copolymer in the binder, there is hardly any effect if it is 1 wt % or less. On the other hand, if it is 35 wt % or more, then the resin's tenacity will be too high to crush it to make toner. The content of ethylene-alpha olefin copolymer is preferable 3–25 wt %.

For the ethylene-vinyl acetate copolymer used in the present invention, the vinyl acetate content, in terms of monomer units, is 3–30 wt %, more preferably 20wt % or less. If the vinyl acetate content is less than 3 wt %, the flowability of the ethylene-vinyl acetate copolymer becomes poor and the toner will easily aggregate. Also, the tendency to crystallize increases and dispersibility with the vinyl copolymer becomes poor and, therefore, fogging may occur during development. A more preferable vinyl acetate content is 6 wt % or more.

On the other hand, if the vinyl acetate content in said ethylene-vinyl acetate copolymer is more than 30 wt %, the glass transition point of the ethylene-vinyl acetate copolymer becomes lower, and this in turn lowers the glass transition point of the resin itself, making the toner aggregate easily.

If the ethylene is highly blocked, then the tendency to crystallize increases and dispersibility with the vinyl copolymer may become poor. Therefore, the ethylene-vinyl acetate copolymer should preferably be close to random copolymerization.

If the molecular weight of the ethylene-vinyl acetate copolymer is too low, the vinyl copolymer may be plasticized and the shelf life will be affected, the resin strength may decrease significantly and smearing will occur, and/or aggregation breakdown may occur to the fixed toner on the interface of that to which the toner is fixed. Therefore, the Mw (weight-average molecular weight) is preferably 1,000 or more, and more preferably 2,000 or more.

In view of the crushability of the resin and dispersibility with the vinyl resin, the Mn (number-average molecular weight) is preferably 40,000 or less, and more preferably 20,000 or less.

The melt flow (ASTM D-1238) of the ethylene-vinyl acetate copolymer at 190° C. must be 600 g/10 min or more, more preferably is 1,400 or more. If it is less than 600 g/10 min, then the viscosity is too high and the flowability becomes insufficient at low temperatures, making it impossible to fix at low temperatures.

For the content of ethylene-vinyl acetate copolymer in the binder, there is hardly any effect if it is 5 wt % or less. On the other hand, if it is 50 wt % or more, then the resin's tenacity will be too high to crush it to make toner. The content of ethylene-vinyl acetate copolymer in the binder is preferably 10–40 wt %.

The copolymer in the present invention is prepared by copolymerizing ethylene and at least one alpha- or beta-derivative of acrylic acid or an unsaturated dicarbonic acid derivative, the content of the alpha- or beta- derivative of acrylic acid or an unsaturated dicarbonic acid derivative is 3–60 wt %. If the content of the alpha- or beta- derivative of acrylic acid or an unsaturated dicarbonic acid derivative is less than 3 wt %, then the flowability of the ethylene copolymer becomes poor and the toner will easily aggregate. Also, the tendency to crystallize increases and dispersibility with the vinyl copolymer becomes poor and, therefore, fogging may occur during development. The content of the alpha- or beta- derivative of acrylic acid or an unsaturated dicarbonic acid derivative is preferably 6 wt % or more.

The content of the alpha- or beta- derivative of acrylic acid or an unsaturated dicarbonic acid derivative in said ethylene copolymer is preferably 25 wt % or less. If it is more than 60 wt %, then compatibility with the vinyl copolymer increases and the vinyl copolymer is plasticized, thus the glass transition point becomes lower, and this in turn lowers the glass transition point of the resin itself, making the toner aggregate easily. More preferable is 25 wt % or less.

Specific examples of the alpha- or beta- derivative of acrylic acid or an unsaturated dicarbonic ester derivative in the ethylene copolymer used in the present invention are: alkyl esters of acrylic acid or methacrylic acid, such as methyl acrylate, ethyl acrylate, propyl acrylate, n-butyl acrylate, isobutyl acrylate, n-octyl acrylate, dodecyl acrylate, 2-ethylhexyl acrylate, stearyl acrylate, methyl methacrylate, ethyl methacrylate, propyl methacrylate, n-butyl methacrylate, isobutyl methacrylate, n-octyl methacrylate, dodecyl methacrylate and stearyl methacrylate; 2-chloroethyl acrylate, phenyl acrylate, methyl alpha-chloro acrylate, phenyl methacrylate, dimethylaminoethyl methacrylate, diethylaminoethyl methacrylate, 2-hydroxyethyl methacrylate, glycidyl methacrylate, bisglycidyl methacrylate, polyethyleneglycol dimethacrylate, methacryloxyethyl phosphate, monoacryloyloxyethylester succinate, monomethacryloyloxyethylester succinate, acrylic acid, methacrylic acid, alpha-ethyl acrylic acid and crotonic acid, fumaric acid, maleic acid, citraconic acid, itaconic acid, maleic anhydride, diethyl fumarate and diethyl maleate.

Since the ethylene copolymer contains a large amount of ethylene, it has a strong tendency to be negatively charged. Therefore, compounds close to the positive end in the electrification rankings are preferable. Particularly preferable are methyl acrylate, ethyl acrylate, methyl methacrylate and ethyl methacrylate.

The ethylene copolymer used in the present invention may be copolymerized with less than 10% of other monomers such as acrylonitrile, methacrylonitrile and acrylamide.

If the ethylene is highly blocked, then the tendency to crystallize increases and dispersibility with the vinyl copolymer may become poor. Therefore, the ethylene copolymer should preferably be close to random copolymerization.

If the molecular weight of the ethylene copolymer is too low, the vinyl copolymer may be plasticized and the shelf life will be affected, the resin strength may decrease significantly and smearing will occur, and/or aggregation breakdown may occur to the fixed toner on the interface of that to which the toner is fixed. Therefore, the Mw (weight-average molecular weight) is preferably 1,000 or more, and more preferably 2,000 or more.

In view of the crushability of the resin and dispersibility with the vinyl resin, the Mn (number-average molecular weight) is preferably 40,000 or less, and more preferably 20,000 or less.

The melt flow (JIS. K-6730) of the ethylene copolymer at 190° C. is preferably 200 g/10 min or more. If it is less than this, then the viscosity is too high and the flowability becomes insufficient at low temperatures, sometimes making it impossible to fix at low temperatures. More preferably it is 400 or more.

For the content of ethylene copolymer in the binder, there is hardly any effect if it is 3 wt % or less. On the other hand, if it is 50 wt % or more, then the resin's tenacity will be too high to crush it to make toner. The content of ethylene copolymer in the binder is preferably is 10–40 wt %.

Synthesis of the vinyl copolymer can be accomplished by methods such as suspension polymerization, emulsion polymerization, solution polymerization or bulk polymerization. The vinyl copolymer and the ethylene-vinyl acetate copolymer can be blended by thermal fusion blending. In order to obtain a more uniform product, however, it is preferable to disperse them in a solvent and then remove the solvent. More preferable is to polymerize the vinyl copolymer in the presence of the ethylene-vinyl acetate copolymer. For an even more uniform result, it can be chemically bonded to the vinyl copolymer by means of blocking, grafting, etc.

In the toner resin composition of the present invention, vinyl acetate, vinyl chloride or ethylene can be copolymerized into said vinyl copolymer, or polymers of these monomers can be blended, as long as the object of the present invention can be achieved. Polyester resin and/or epoxy resin can also be blended. Furthermore, aliphatic amide, bis aliphatic amide, metallic soap, paraffin, etc. can be mixed in.

Electrification control agents including dyes such as Nigrosine and Spiron Black (from Hodogaya Kagaku) and/or phthalocyanine pigments can also be added, as long as the object of the present invention can be achieved. For coloring, carbon black, chrome yellow, aniline blue, etc. can be used.

Toner-separating agents such as low molecular weight polyester or polypropylene wax can also be added. It is also possible to add hydrophobic silica and such to increase flowability.

The toner resin composition of the present invention is configured as described thus far, and its vinyl copolymer has, in its molecular weight distribution curve, at least a peak in the range of $1\times10^3$–$8\times10^4$, plus a peak or a shoulder in the range of $1\times10^5$–$4\times10^6$, or a Mw/Mn of 6 or more, or 5 wt % or more of the toluene nonsoluble component. Because of this, low temperature fixability and anti-offset properties are improved.

Since an ethylene copolymer with a low viscosity at lower temperatures is included, a toner resin composition which is fixable at lower temperatures can be obtained.

Also, since a specific amount of the ethylene copolymer, which is tenacious and easy to disperse in the vinyl copolymer, is included, the tenacity of the toner resin composition increases and this makes it possible to obtain toner which does not cause smearing and does not easily aggregate.

The toner resin composition of the present invention is configured as described thus far, and it has a vinyl copolymer as the primary component and also contains an ethylene copolymer. By introducing a specific amount of a specific ethylene copolymer into a vinyl copolymer with a specific molecular weight distribution, it was possible to provide a toner resin composition with superior anti-offset, anti-aggregation and anti-smearing properties which is fixable at lower temperatures.

EXAMPLES

Example 1

A mixture of 200 g of a resin with a molecular weight peak at 600,000, obtained by polymerizing 70 parts of styrene, 10 parts of methyl methacrylate and 20 parts of n-butyl acrylate, and 160 g of an ethylene-butene copolymer DT024 (butene content: 7 mol %, Mw=40,000, Mn=10,000, viscosity: 27 poises @140° C., from Mitsui Petrochemical Industries, Ltd.) were put into a 3-liter separatable flask and dissolved in 1 liter of toluene. After the gas phase was replaced by nitrogen gas, this system was heated to the boiling point of toluene.

After the refluxing of toluene had begun, a dissolved mixture of 440 g of styrene, 65 g of n-butyl acrylate and 30 g of t-butylperoxy 2-ethylhexanoate, as a polymerization starter, was dripped into the system for 2.5 hours, during which the solution polymerization took place. After the completion of dripping, the system was aged for 1 hour with agitation at the boiling temperature of toluene. The system temperature was then gradually raised to 180° C., while toluene was removed under reduced pressure to obtain resin A which has a peak value of its molecular weight of 8,000, a glass transition temperature of 63° C., and a Mw/Mn of 27. 100 weight parts of resin A, 5 weight parts of carbon black (from Mitsubishi Chemical Industries, Ltd., product name: MA-100), 1 weight part of Spiron Black TRH and 3 weight parts of PP wax (from Sanyo Chemical Industries, Ltd., product name: Viscol 660P) were melt-blended, cooled, coarsely crushed and then finely crushed with a jet-mill to obtain toner powder with an average particle size of approximately 12–15 micrometers.

Toner was prepared by adding 0.3 weight parts of hydrophobic silica powder (from Aerosil Japan, product name: R-972) to the toner-powder thus obtained.

10 g of this toner was put into a 100 ml sample bottle, and let stand for 16 hours in a 50° C. thermostatic bath, followed by measurement of the degree of aggregation using a powder tester (from Hosokawa Micron, Ltd.). No aggregation was observed.

4 weight parts of this toner and 96 weight parts of iron powder carrier with an average particle size of approximately 50–80 micrometers were mixed to prepare a developing agent, and this developing agent was used to obtain copies. The electronic copier used was Mita DC-5055 with some modifications.

Copies were made at various temperatures of the heated roller of the electronic copier. Said copies were then rubbed with a typewriter eraser (ER-502R, manufactured by LION) [a rubber eraser with fine abrasive particles in it, called a "sand eraser" in Japan and used for erasing letters typed in ink], and the temperature setting at which the density of the copy images changed after rubbing was defined as the fixing temperature. The fixing temperature of the developing agent using resin A was 140° C., which was sufficiently low.

The offset occurring temperature was defined as the temperature setting at which the offset phenomenon occurs when obtaining copies at various temperature settings of the heated roller of the electronic copier. The offset occurring temperature of the developing agent using resin A was 200° C. or higher, which was sufficiently high.

For images fixed at 170° C., no smearing was observed after rubbing the surface with gauze.

Example 2

85 g of an ethylene-butene copolymer DT032 (butene content: 8 mol %, Mw=50,000, Mn=15,000, viscosity: 28 poises @140° C., from Mitsui Petrochemical Industries, Ltd.), 300 g of styrene, 120 g of n-butyl acrylate, 700 g of toluene, and 0.25 g of a catalyst Kaya Ester HTP (from Kayaku Nuley) were put into a 3-liter separatable flask and dissolved in 1 liter of toluene.

After the gas phase was replaced by nitrogen gas, this system was heated to the boiling point of toluene. After the refluxing of toluene had begun, the system was agitated for 10 hours to polymerize the high molecular weight polymer. After this, a mixture of 500 g of styrene, 120 g of butyl methacrylate and 12 g of AIBN was dripped into the system for 2 hours, during which the solution polymerization took place. After the completion of dripping, the system was aged for 3 hours with agitation at the boiling temperature of toluene. The system temperature was then gradually raised to 180° C., while toluene was removed under reduced pressure to obtain resin B which has peak values for its molecular weight distribution at 20,000 and 300,000, a glass transition temperature of 57° C., and Mw/Mn of 18.

100 weight parts of resin B, 5 weight parts of carbon black (from Mitsubishi Chemical Industries, Ltd., product name: MA-100), 1 weight part of Spiron Black TRH and 3 weight parts of PP wax (from Sanyo Chemical Industries, Ltd., product name: Viscol 660P) were melt-blended, cooled, coarsely crushed and then finely crushed with a jet-mill to obtain toner powder with an average particle size of approximately 12–15 micrometers.

Toner was prepared by adding 0.3 weight parts of hydrophobic silica powder (from Aerosil Japan, product name: R-972) to the toner powder thus obtained.

10 g of this toner was put into a 100 ml sample bottle, and let stand for 16 hours in a 50° C. thermostatic bath, followed by measurement of the degree of aggregation using a powder tester (from Hosokawa Micron, Ltd.). No aggregation was observed.

Testing was conducted in the same manner as in Example 1. The fixing temperature was 140° C., which was sufficiently low. The offset occurring temperature was 200° C. or higher, which was sufficiently high. No smearing was observed.

Comparative Example 1

A developing agent was prepared in the same manner as in Example 1, except for the fact that 4 g, instead of 160 g, of the ethylene-butene copolymer was used, and the testing was conducted.

No aggregation was observed. The offset occurring temperature was 200° C. or higher. However, the fixing temperature was 150° C. and smearing was observed.

Comparative Example 2

A developing agent was prepared in the same manner as in Example 1, except for the fact that the ethylene-butene copolymer was not used, and that 2 g of divinylbenzene was added as a cross linking agent to the low molecular weight polymerization solution to obtain a resin with a low molecular weight peak at 20,000 and a glass transition point of 64° C. and this resin was used instead. The results of the testing follow: no aggregation was observed; no smearing was observed; the offset occurring temperature was 200° C. or higher; however, the fixing temperature was 170° C., which was rather high.

Comparative Example 3

A developing agent was prepared in the same manner as in Example 1, except for the fact that only the low molecular weight polymer was synthesized and used. The results of the testing follow: no aggregation was observed; the fixing temperature was 140° C.; however, the offset occurring temperature was 160° C., which is rather low; and smearing was observed.

Comparative Example 4

A resin was prepared in the same manner as in Example 1, except for the fact 400 g, instead of 160 g, of the ethylene-butene copolymer was used. 100 weight parts of this resin, 5 weight parts of carbon black (from Mitsubishi Chemical Industries, Ltd., product name: MA-100), 1 weight part of Spiron Black TRH and 3 weight parts of PP wax (from Sanyo Chemical Industries, Ltd., product name: Viscol 660P) were melt-blended, cooled, coarsely crushed and then finely crushed with a jet-mill. However, the crushability was poor and the toner obtained had an average particle size of approximately 50–100 micrometers, hence it was not possible to prepare a developing agent.

Comparative Example 5

A developing agent was prepared in the same manner as in Example 2, except for the fact that, instead of the ethylene-butene copolymer, polyethylene with a molecular weight of approximately 4,000 (viscosity 70 poises @140° C., product name: Hi-Wax from Mitsui Petrochemical Industries, Ltd.) was used. The results of the testing follow: the offset occurring temperature was 200° C. or higher; however, aggregation was observed; the fixing temperature was 150° C.; and smearing was observed.

Comparative Example 6

A developing agent was prepared in the same manner as in Example 1, except for the fact that, instead of the ethylene-butene copolymer DT032, Toughmer-A A-4085 (butene content 8 mol %, molecular weight approximately 200,000, viscosity 30,000 poises @140° C., from Mitsui Petrochemical Industries, Ltd.) was used. Because of poor crushability, the average particle size of the toner was approximately 20–25 micrometers. The results of the testing follow: no aggregation was observed; the offset occurring temperature was 200° C. or higher; however, smearing was observed; and the fixing temperature was 160° C.

Example 3

A mixture of 300 g of a resin with a toluene nonsoluble content of 70 wt %, obtained by polymerizing 60 parts of styrene and 40 parts of n-butyl methacrylate, and 160 g of an ethylene-butene copolymer DT024 (butene content: 7 mol %, Mw=40,000, Mn=10,000, viscosity: 27 poises @140° C., from Mitsui Petrochemical Industries, Ltd.) were put into a 3-liter separatable flask and dissolved in 1 liter of toluene. After the gas phase was replaced by nitrogen gas, this system was heated to the boiling point of toluene.

After the refluxing of toluene had begun, a dissolved mixture of 440 g of styrene, 65 g of 2-ethylhexyl acrylate and 20 g of benzoyl peroxide, as a polymerization starter, was dripped into the system for 2.5 hours, during which the solution polymerization took place. After the completion of dripping, the system was aged for 3 hours with agitation at the boiling temperature of toluene. The system temperature was then gradually raised to 180° C., while toluene was removed under reduced pressure to obtain resin C which has a peak of its lower molecular weight polymer at 12,000 and a glass transition temperature of 59° C.

100 weight parts of resin C, 5 weight parts of carbon black (from Mitsubishi Chemical Industries, Ltd., product name: MA-100), 1 weight part of Spiron Black TRH and 3 weight parts of PP wax (from Sanyo Chemical Industries, Ltd., product name: Viscol 660P) were melt-blended, cooled, coarsely crushed and then finely crushed with a jet-mill to obtain toner powder with an average particle size of approximately 12–15 micrometers.

Toner was prepared by adding 0.3 weight parts of hydrophobic silica powder (from Aerosil Japan, product name: R-972) to the toner powder thus obtained.

10 g of this toner was put into a 100 ml sample bottle, and let stand for 16 hours in a 50° C. thermostatic bath, followed by measurement of the degree of aggregation using a powder tester (from Hosokawa Micron, Ltd.). No aggregation was observed.

4 weight parts of this toner and 96 weight parts of iron powder carrier with an average particle size of approximately 50–80 micrometers were mixed to prepare a developing agent, and this developing agent was used to obtain copies. The electronic copier used was Mita DC-5055 with some modifications.

Copies were made for various temperatures of the heated roller of the electronic copier. Said copies were then rubbed with a typewriter eraser (ER-502R, manufactured by LION), and the temperature setting at which the density of the copy images changed after rubbing was defined as the fixing temperature. The fixing temperature of the developing agent using resin C was 140° C., which was sufficiently low.

The offset occurring temperature was defined as the temperature setting at which the offset phenomenon occurs when obtaining copies at various temperature settings of the heated roller of the electronic copier. The offset occurring temperature of the developing agent using resin C was 200° C. or higher, which was sufficiently high.

For images fixed at 170° C., no smearing was observed after rubbing the surface with gauze.

Comparative Example 7

A developing agent was prepared in the same manner as in Example 3, except for the fact that the ethylene-butene copolymer was not used. The results of the testing follow: no aggregation was observed; the offset occurring temperature was 200° C. or higher; however, the fixing temperature was 150° C.; and, smearing was observed.

Example 4

900 g of toluene was put into a 3-liter separatable flask, and 170 g of the ethylene-vinyl acetate copolymer Elvax 500W (vinyl acetate content: 10 wt %, softening point: 91° C., average molecular weight: approximately 10,000, melt-flow: 2,500, from Du Pont-Mitsui Chemicals) and 230 g of the high molecular weight polymer with a molecular weight of approximately 800,000, prepared from 70 parts of styrene and 30 parts of n-butyl acrylate, were dissolved in it.

After the gas phase was replaced by nitrogen gas, this system was heated to the boiling point of toluene.

After the refluxing of toluene had begun, a dissolved mixture of 550 g of styrene, 50 g of methyl methacrylate, 100 g of n-butyl acrylate and 20 g of t-butylperoxy 2-ethylhexanoate, as a polymerization starter, was dripped into the system for 2.5 hours, during which the solution polymerization took place. After the completion of dripping, the system was aged for 2 hours with agitation at the boiling temperature of toluene. The system temperature was then gradually raised to 180° C, while toluene was removed under reduced pressure to obtain a resin. This resin was cooled and crushed to obtain resin D of the present invention.

The molecular weight distribution of the vinyl copolymer without the ethylene-vinyl acetate copolymer had peaks at 15,000 and 700,000, and it had a Mw/Mn of 18 and Tg of 60° C.

100 weight parts of resin D. 5 weight parts of carbon black (from Mitsubishi Chemical Industries, Ltd., product name: MA-100), 1 weight part of Spiron Black TRH and 3 weight parts of PP wax (from Sanyo Chemical Industries, Ltd., product name: Viscol 660P) were melt-blended, cooled, coarsely crushed and then finely crushed with a jet-mill to obtain toner powder with an average particle size of approximately 12–15 micrometers.

Toner was prepared by adding 0.3 weight parts of hydrophobic silica powder (from Aerosil Japan, product name: R-972) to the toner powder thus obtained.

10 g of this toner was put into a 100 ml sample bottle, and let stand for 16 hours in a 50° C. thermostatic bath, followed by measurement of the degree of aggregation using a powder tester (from Hosokawa Micron, Ltd.). No aggregation was observed.

4 weight parts of this toner and 96 weight parts of iron powder carrier with an average particle size of approximately 50–80 micrometers were mixed to prepare a developing agent, and this developing agent was used to obtain copies. The electronic copier used was Fuji Xerox 3500 with some modifications.

Copies were made at various temperatures of the heated roller of the electronic copier. Said copies were then rubbed with a typewriter eraser (ER-502R, manufactured by LION), and the temperature setting at which the density of the copy images changed after rubbing was defined as the fixing temperature. The fixing temperature of the developing agent using resin D was 130° C., which was sufficiently low.

The offset occurring temperature was defined as the temperature setting at which the offset phenomenon occurs when obtaining copies with various temperature settings of the heated roller of the electronic copier. The offset occurring temperature of the developing agent using resin D was 190° C. or higher, which was sufficiently high.

No smearing was observed after rubbing the fixed images with a finger.

Example 5

900 g of toluene was put into a 3-liter separatable flask, and 200 g of the ethylene-vinyl acetate copolymer Elvax 500W (vinyl acetate content: 10 wt %, softening point: 91° C., average molecular weight: approximately 10,000, melt-flow: 2,500, from Du Pont-Mitsui Chemicals) was dissolved in it. After the gas phase was replaced by nitrogen gas, this system was heated to the boiling point of toluene.

After the refluxing of toluene had begun, a dissolved mixture of 600 g of styrene, 200 g of n-butyl methacrylate, 8 g of divinyl benzene, as a cross linking agent, 40 g of benzoyl peroxide, as a polymerization starter, was dripped into the system for 8 hours, during which the solution polymerization took place. After the completion of dripping, the system was aged for 8 hours with agitation at the boiling temperature of toluene. The system temperature was then gradually raised to 180° C., while toluene was removed under reduced pressure to obtain a resin. This resin was cooled and crushed to obtain resin E of the present invention.

The molecular weight distribution of the vinyl copolymer without the ethylene-vinyl acetate copolymer had a peak at 10,000, and it had a Mw/Mn of 10, Tg of 64° C. and contained 11 wt % of a gel component.

A developing agent was prepared in the same manner as in Example 4, except for the fact that resin E was used instead of resin D. The results of the testing follow: no aggregation was observed; the fixing temperature was 140° C.; and, the offset occurring temperature was 190° C. or higher.

No smearing was observed after rubbing the fixed images with a finger.

Example 6

88 weight parts of a resin which has peaks at 7,000 and 2,000,000 in its molecular weight distribution, a Mw/Mn of 40 and Tg of 58° C., prepared by polymerizing 70 parts of styrene, 20 parts of butyl methacrylate and 10 parts of n-butyl acrylate, and 12 weight parts of the ethylene-vinyl acetate copolymer Evaflex V577 (vinyl acetate content: 19 wt %, softening point: 78° C., average molecular weight: approximately 15,000: melt-flow: 800, from Du Pont-Mitsui Chemicals) were kneaded in a nitrogen-gas-substituted kneader for 10 minutes at 160° C. The resin obtained was cooled and crushed to obtain resin F of the present invention.

100 weight parts of resin F, 5 weight parts of carbon black (from Mitsubishi Chemical Industries, Ltd., product name: MA-100) and 1 weight part of Spiron Black TRH were melt-blended, cooled, coarsely crushed and then finely crushed with a jet-mill to obtain toner powder with an average particle size of approximately 12–15 micrometers.

Toner was prepared by adding 0.3 weight parts of hydrophobic silica powder (from Aerosil Japan, product name: R-972) to the toner powder thus obtained.

A developing agent was prepared in the same manner as in Example 4. The results of the testing follow: no aggregation was observed; the fixing temperature was 140° C.; and the offset occurring temperature was 200° C. or higher.

No smearing was observed after rubbing the fixed images with a finger.

Example 7

900 g of toluene was put into a 3-liter separatable flask, and 300 g of the ethylene-vinyl acetate copolymer Elvax 200W (vinyl acetate content: 28 wt %, softening point: 71 ° C., average molecular weight: approximately 10,000, melt-flow: 2,500, from Du Pont-Mitsui Chemicals) and 250 g of the high molecular weight polymer with a molecular weight of approximately 800,000, composed of 70 parts of styrene and 30 parts of n-butyl acrylate, were dissolved in it. After the gas phase was replaced by nitrogen gas, this system was heated to the boiling point of toluene.

After the refluxing of toluene had begun, a dissolved mixture of 380 g of styrene, 70 g of n-butyl acrylate and 10 g of t-butylperoxy 2-ethylhexanoate, as a polymerization starter, was dripped into the system for 3 hours, during which the solution polymerization took place. After the completion of dripping, the system was aged for 3 hours with agitation at the boiling temperature of toluene. The system temperature was then gradually raised to 180° C., while toluene was removed under reduced pressure to obtain a resin. This resin was cooled and crushed to obtain resin G of the present invention.

The molecular weight distribution of the vinyl copolymer without the ethylene-vinyl acetate copolymer had peaks at 20,000 and 700,000, and it had a Mw/Mn of 16 and Tg of 63° C.

50 weight parts of resin G, 50 weight parts of magnetite (average particle size: 0.3 micrometers), 4 weight parts of carbon black (from Mitsubishi Chemical Industries, Ltd., product name: MA-100), 4 weight parts of Nigrosine and 2 weight parts of PP wax (from Sanyo Chemical Industries, Ltd., product name: Viscol 550P) were melt-blended, cooled, coarsely crushed and then finely crushed with a jet-mill to obtain toner powder with an average particle size of approximately 12–15 micrometers.

Toner was prepared by adding 0.3 weight parts of hydrophobic silica powder (from Aerosil Japan, product name: R-972) to the toner powder thus obtained.

10 g, of this toner was put into a 100 ml sample bottle, and let stand for 16 hours in a 50° C. thermostatic bath, followed by measurement of the degree of aggregation using a powder tester (from Hosokawa Micron, Ltd.). No aggregation was observed.

4 weight parts of this toner and 96 weight parts of iron powder carrier with an average particle size of approximately 50–80 micrometers were mixed to prepare a developing agent, and this developing agent was used to obtain copies. The electronic copier used was SF-7700 manufactured by Sharp with some modifications.

Copies were made at various temperatures of the heated roller of the electronic copier. Said copies were then rubbed with a typewriter eraser (ER-502R, manufactured by LION), and the temperature setting at which the density of the copy images changed after rubbing was defined as the fixing temperature. The fixing temperature of the developing agent using resin G was 140° C., which was sufficiently low.

The offset occurring temperature was defined as the temperature setting at which the offset phenomenon occurs when obtaining copies at various temperature settings of the heated roller of the electronic copier. The offset occurring temperature of the developing agent using resin G was 190° C. or higher, which was sufficiently high.

No smearing was observed after rubbing the fixed images with a finger.

Comparative Example 8

A developing agent was prepared in the same manner as in Example 4, except for the fact that the ethylene-vinyl acetate copolymer was not incorporated into resin D. The results of the testing follow: no aggregation was observed: the offset occurring temperature was 190° C.; however, the fixing temperature was 160° C., which was inferior to that of resin D of the present invention.

Also, smearing was observed after rubbing the fixed images with a finger.

Comparative Example 9

A developing agent was prepared in the same manner as in Example 4, except for the fact that, instead of the ethylene-vinyl acetate copolymer, polyethylene wax was incorporated into resin D.

The results of the testing follow: the offset occurring temperature was 200° C. or higher; however, aggregation was observed; and the fixing temperature was 160° C., which was inferior to that of resin D of the present invention.

Also, the fixed images sustained severe fogging, and severe smearing was observed after rubbing the fixed images with a finger.

Comparative Example 10

A developing agent was prepared in the same manner as in Example 4, except for the fact that, instead of the ethylene-vinyl acetate copolymer Elvax 500W (vinyl acetate content: 10 wt %, softening point: 91 ° C., average molecular weight: approximately 10,000, melt-flow: 2,500, from Du Pont-Mitsui Chemicals), an ethylene-vinyl copolymer with a vinyl acetate content of 33 wt %, a softening point of 69° C., an average molecular weight of approximately 10,000, and a melt flow of 2,500 was incorporated into resin D. The results of the testing follow: the fixing temperature was 130° C.; the offset occurring temperature was 190° C.; however, aggregation was observed.

No smearing was observed after rubbing the fixed images with a finger.

Comparative Example 11

A developing agent was prepared in the same manner as in Example 4, except for the fact that, instead of the ethylene-vinyl acetate copolymer Elvax 500W (vinyl acetate content: 10 wt %, softening point: 91 ° C., average molecular weight: approximately 10,000, melt-flow: 2,500, from Du Pont-Mitsui Chemicals), an ethylene-vinyl copolymer Elvax EV5772 (vinyl acetate content: 33 wt %, softening point: 69° C., average molecular weight: approximately 15,000, melt-flow: 400, from Du Pont-Mitsui Chemicals) was incorporated into resin D. The results of the testing follow: the offset occurring temperature was 190° C.; no aggregation was observed; however, the fixing temperature was 150° C., which was inferior to that of resin D of the present invention.

No smearing was observed after rubbing the fixed images with a finger.

Comparative Example 12

A developing agent was prepared in the same manner as in Example 4, except for the fact that, instead of the ethylene-vinyl acetate copolymer Elvax 500W (vinyl acetate content: 10 wt %, softening point: 91 ° C., average molecular weight: approximately 10,000, melt-flow: 2,500, from Du Pont-Mitsui Chemicals), an ethylene-vinyl copolymer Evaflex EV210 (vinyl acetate content: 28 wt %, softening point: 71 ° C., average molecular weight: approximately 15,000, melt-flow: 400, from Du Pont-Mitsui Chemicals) was incorporated into resin D. The results of the testing follow: the offset occurring temperature was 190° C.; no aggregation was observed: however, the fixing temperature was 150° C., which was inferior to that of resin D of The present invention.

No smearing was observed after rubbing the fixed images with a finger.

Comparative Example 13

A developing agent was prepared in the same manner as in Example 4, except for the fact that 30 g, instead 200 g, of the ethylene-vinyl acetate copolymer was used in resin E. The results of the testing follow: no aggregation was observed; however, the fixing temperature was 160° C. and the offset occurring temperature was 200° C., which were inferior to those of resin E of the present invention.

Also, some smearing was observed after rubbing the fixed images with a finger.

Comparative Example 14

The same procedure as in Example 6 was followed, except for the fact that 100 weight parts, instead of 12 weight parts, of the ethylene-vinyl acetate copolymer was introduced in resin F. It was impossible to crush the product down to a particle size of 30 micrometers or less, hence it could not be made into toner.

Comparative Example 15

A developing agent was prepared in the same manner as in Example 4, except for the fact that: 2 g, instead of 20 g, of t-butylperoxy 2-ethylhexanoate was used; the aging time was 20 hours instead of 2 hours; the vinyl copolymer, without the ethylene-vinyl acetate copolymer, had peaks at 100,000 and 700,000 in its molecular weight distribution curve, a Mw/Mn of 6, and Tg of 67° C. The results of the testing follow: the offset occurring temperature was 200° C. or higher; no aggregation was observed: however, the fixing temperature was 160° C., which was inferior to that of resin D of the present invention.

No smearing was observed after rubbing the fixed images with a finger.

Example 8

900 g of toluene was put into a 3-liter separatable flask, and 210 g of the ethylene-ethyl acrylate copolymer EEA-A715 (ethyl acrylate content: 25 wt %, average molecular weight: approximately 15,000, melt-flow: 800, from Du Pont-Mitsui Chemicals) was dissolved in it. After the gas phase was replaced by nitrogen gas, this system was heated to the boiling point of toluene.

After the refluxing of toluene had begun, a dissolved mixture of 590 g of styrene, 200 g of n-butyl methacrylate, 8 g of divinyl benzene, as a cross linking agent, and 40 g of benzoyl peroxide, as a polymerization starter, was dripped into the system for 8 hours, during which the solution polymerization took place. After the completion of dripping, the system was aged for 8 hours with agitation at the boiling temperature of toluene. The system temperature was then gradually raised to 180° C., while toluene was removed under reduced pressure to obtain a resin. This resin was cooled and crushed to obtain resin H of the present invention.

The molecular weight distribution of the vinyl copolymer without the ethylene-ethyl acrylate copolymer had a peak at 10,000, and it had a Mw/Mn of 10, Tg of 64° C. and contained 15 wt % of a gel component.

100 weight parts of resin H, 5 weight parts of carbon black (from Mitsubishi Chemical Industries, Ltd., product name: MA-100), 0.5 weight parts of Spiron Black TRH and 3 weight parts of PP wax (from Sanyo Chemical Industries, Ltd., product name: Viscol 660P) were melt-blended, cooled, coarsely crushed and then finely crushed with a jet-mill to obtain toner powder with an average particle size of approximately 12–15 micrometers.

Toner was prepared by adding 0.3 weight parts of hydrophobic silica powder (from Aerosil Japan, product name: R-972) to the toner powder thus obtained.

10 g of this toner was put into a 100 ml sample bottle, and let stand for 16 hours in a 50° C. thermostatic bath, followed by measurement of the degree of aggregation using a powder tester (from Hosokawa Micron, Ltd.). No aggregation was observed.

4 weight parts of this toner and 96 weight parts of iron powder carrier with an average particle size of approximately 50–80 micrometers were mixed to prepare a developing agent, and this developing agent was used in an electronic copier to obtain copies. The electronic copier used was Fuji Xerox 3500 with some modifications.

Copies were made at various temperatures of the heated roller of the electronic copier. Said copies were then rubbed with a typewriter eraser (ER-502R, manufactured by LION), and the temperature setting at which the density of the copy images changed after rubbing was defined as the fixing temperature. The fixing temperature of the developing agent using resin H was 140° C., which was sufficiently low.

The offset occurring temperature was defined as the temperature setting at which the offset phenomenon occurs when obtaining copies at various temperature settings of the heated roller of the electronic copier. The offset occurring temperature of the developing agent using resin H was 190° C. or higher, which was sufficiently high.

No smearing was observed after rubbing the fixed images with a finger.

Example 9

900 g of toluene was put into a 3-liter separatable flask, and 180 g of the ethylene-methyl methacrylate copolymer with a methyl methacrylate content of 15 wt %, a softening point of 85° C., an average molecular weight of approximately 10,000 and a melt flow of 2,500 and 220 g of a high molecular weight polymer with a molecular weight of approximately 800,000, prepared from 70 parts of styrene and 30 parts of n-butyl acrylate, were dissolved in it. After the gas phase was replaced by nitrogen gas, this system was heated to the boiling point of toluene.

After the refluxing of toluene had begun, a dissolved mixture of 550 g, of styrene, 50 g of methyl methacrylate, 100 g of n-butyl acrylate and 20 g of t-butylperoxy 2-ethylhexanoate, as a polymerization starter, was dripped into the system for 2.5 hours, during which the solution polymerization took place. After the completion of dripping, the system was aged for 2 hours with agitation at the boiling temperature of toluene. The system temperature was then gradually raised to 180° C., while toluene was removed under reduced pressure to obtain a resin. This resin was cooled and crushed to obtain resin I of the present invention.

The molecular weight distribution of the vinyl copolymer without the ethylene-methyl methacrylate copolymer had peaks at 15,000 and 700,000, and it had a Mw/Mn of 17 and Tg of 60° C.

A developing agent was prepared in the same manner as in Example 8, except for the fact that, instead of resin H, resin I was used. The results of the testing follow: no aggregation was observed; the fixing temperature was 130° C.; and, the offset occurring temperature was 190° C. or higher.

No smearing was observed after rubbing the fixed images with a finger.

Example 10

900 g of toluene was put into a 3-liter separatable flask, and 100 g of the ethylene-methacrylic acid Neucrel (methacrylic acid content: 10 wt %, average molecular weight: approximately 20,000, melt-flow: 500, from Du Pont-Mitsui Chemicals) and 250 g of the high molecular weight polymer with a molecular weight of approximately 800,000, prepared from 70 parts of styrene and 30 parts of n-butyl acrylate, were dissolved in it. After the gas phase was replaced by nitrogen gas, this system was heated to the boiling point of toluene.

After the refluxing of toluene had begun, a dissolved mixture of 400 g of styrene, 100 g of n-butyl acrylate and 10 g of t-butylperoxy 2-ethylhexanoate, as a polymerization starter, was dripped into the system for 3 hours, during which the solution polymerization took place. After the completion of dripping, the system was aged for 3 hours with agitation at the boiling temperature of toluene. The system temperature was then gradually raised to 180° C., while toluene was removed under reduced pressure to obtain a resin. This resin was cooled and crushed to obtain resin J of the present invention.

The molecular weight distribution of the vinyl copolymer without the ethylene-methacrylic acid copolymer had peaks at 20,000 and 700,000, and it had a Mw/Mn of 15 and Tg of 55° C.

50 weight parts of resin J, 50 weight parts of magnetite (average particle size: 0.3 micrometers), 4 weight parts of carbon black (from Mitsubishi Chemical Industries, Ltd., product name: MA-100), 4 weight parts of Nigrosine and 2 weight parts of PP wax (from Sanyo Chemical Industries, Ltd., product name: Viscol 550P) were melt-blended, cooled, coarsely crushed and then finely crushed with a jet-mill to obtain toner powder with an average particle size of approximately 12–15 micrometers.

Toner was prepared by adding 0.3 weight parts of hydrophobic silica powder (from Aerosil Japan, product name: R-972) to the toner powder thus obtained.

10 g of this toner was put into a 100 ml sample bottle, and let stand for 16 hours in a 50° C. thermostatic bath, followed by measurement of the degree of aggregation using a powder tester (from Hosokawa Micron, Ltd.). No aggregation was observed.

4 weight parts of this toner and 96 weight parts of iron powder carrier with an average particle size of approximately 50–80 micrometers were mixed to prepare a developing agent, and this developing agent was used in an electronic copier to obtain copies. The electronic copier used was SF-7700 manufactured by Sharp with some modifications.

Copies were made at various temperatures of the heated roller of the electronic copier. Said copies were then rubbed with a typewriter eraser (ER-502R, manufactured by LION), and the temperature setting at which the density of the copy images changed after rubbing was defined as the fixing temperature. The fixing temperature of the developing agent using resin J was 140° C., which was sufficiently low.

The offset occurring temperature was defined as the temperature setting at which the offset phenomenon occurs when obtaining copies with various temperature settings of the heated roller of the electronic copier. The offset occurring temperature of the developing agent using resin J was 190° C. or higher, which was sufficiently high.

No smearing was observed after rubbing the fixed images with a finger.

Comparative Example 16

A developing agent was prepared in the same manner as in Example 8, except for the fact that the ethylene-ethyl acrylate copolymer was not incorporated into resin H. The results of the testing follow: no aggregation was observed; the offset occurring temperature was 190° C.; however, the fixing temperature was 160° C., which was inferior to that of resin H of the present invention.

Also, smearing was observed after rubbing the fixed images with a finger.

Comparative Example 17

A developing agent was prepared in the same manner as in Example 8, except for the fact that, instead of the ethylene-vinyl acetate copolymer, polyethylene wax was incorporated into resin H.

The results of the testing follow: the offset occurring temperature was 200° C. or higher; however, aggregation was observed; and the fixing temperature was 160° C., which was inferior to that of resin H of the present invention.

Also, the fixed images sustained severe fogging, and severe smearing was observed after rubbing the fixed images with a finger.

Comparative Example 18

A developing agent was prepared in the same manner as in Example 8, except for the fact that, instead of the ethylene-ethyl acrylate copolymer EEA-A715 (ethyl acrylate content: 25 wt %, average molecular weight: approximately 15,000, melt-flow: 800, from Du Pont-Mitsui Chemicals), the ethylene-ethyl acrylate copolymer with an ethyl acrylate content of 65 wt %, an average molecular weight of approximately 15,000, and a melt flow of 800 was incorporated into resin H. The results of the testing follow: the fixing temperature was 140° C.; the offset occurring temperature was 190° C.; however, aggregation was observed.

No smearing was observed after rubbing the fixed images with a finger.

Comparative Example 19

A developing agent was prepared in the same manner as in Example 9, except for the fact that 20 g, instead 220 g, of the ethylene-methyl methacrylate copolymer was used in resin I. The results of the testing follow: no aggregation was observed; however, the fixing temperature was 160° C. and the offset occurring temperature was 200° C., which were inferior to those of resin I of the present invention.

Also, some smearing was observed after rubbing the fixed images with a finger.

Comparative Example 20

The same procedure as in Example 8 was followed, except for the fact that 1,000 g, instead of 210 g, of the ethylene-ethyl acrylate copolymer was introduced in resin H. It was impossible to crush the product down to a particle size of 30 micrometers or less, hence it could not be made into toner.

Comparative Example 21

A developing agent was prepared in the same manner as in Example 9, except for the fact that: 2 g, instead of 20 g, of t-butylperoxy 2-ethylhexanoate was used; the aging time was 20 hours instead of 2 hours; the vinyl copolymer, without the ethylene-methyl methacrylate copolymer, had peaks at 100,000 and 700,000 in its molecular weight distribution curve, a Mw/Mn of 6, and Tg of 67° C. The results of the testing follow: the offset occurring temperature was 200° C. or higher; no aggregation was observed; however, the fixing temperature was 160° C., which was inferior to that of resin I of the present invention.

No smearing was observed after rubbing the fixed images with a finger.

What is claimed is:

1. A toner having a binder composed primarily of vinyl copolymer, the improvement comprising a vinyl copolymer which has, in its molecular weight distribution curve, at least a peak in the range of $1\times10^3$–$8\times10^4$, plus a peak or a shoulder in the range of $1\times10^5$–$4\times10^6$, or a Mw/Mn of 6 or more, or 5 wt % or more of a toluene nonsoluble component, and contains throughout the binder 3–50 wt % of ethylene copolymer, wherein said vinyl copolymer has a structural unit of a styrene or methacrylic ester monomer and another vinyl monomer, and said ethylene copolymer is a copolymer prepared by copolymerizing ethylene and at least one alpha- or beta- derivative of acrylic acid or an unsaturated dicarbonic acid derivative.

2. The toner of claim 1, wherein the vinyl copolymer has, in its molecular weight distribution curve, at least a peak in the range of $3\times10^3$–$4\times10^4$, plus a peak or a shoulder in the range of $1\times10^5$–$4\times10^6$ or a Mw/Mn of 10 or more, or 15 wt % or more of a toluene nonsoluble component, and 10–40 wt % of copolymer prepared by copolymerizing ethylene and at least one alpha- or beta- derivative of acrylic acid or an unsaturated dicarbonic acid derivative is contained therein, said copolymer having a melt-flow (ASTM D-1238) of 200 g/10 min or more at 190° C., a content of the alpha- or beta-derivative of acrylic acid or unsaturated dicarbonic acid derivative of 6–20 wt %, a weight-average molecular weight of 2,000 or more and a number-average molecular weight of 20,000 or less.

3. A toner having a binder-composed primarily of vinyl copolymer, the improvement comprising a vinyl copolymer which has, in its molecular weight distribution curve, at least a peak in the range of $1\times10^3$–$8\times10^4$, plus a peak or a shoulder in the range of $1\times10^5$–$4\times10^6$, or a Mw/Mn of 6 or more, or 5 wt % or more of a toluene nonsoluble component, and contains throughout the binder 3–50 wt % of ethylene copolymer, wherein said vinyl copolymer comprises structural units selected from the group consisting styrene monomers, acrylic ester monomers, methacrylic ester monomers, and mixtures thereof, and said ethylene compolymer is a copolymer prepared by copolymerizing ethylene and at least one alpha- or beta-derivative of acrylic acid or an unsaturated dicarbonic acid derivative.

4. The toner of claim 3, wherein the styrene monomers are selected from the group consisting of styrene, o-methylstyrene, m-methylstyrene, p-methylstyrene, alpha-methylstyrene, p-ethylstyrene, 2,4-dimethylstyrene, p-n-butylstyrene, p-tert-butylstyrene, p-n-hexylstyrene, p-n-octylstyrene, p-n-dodecylstyrene, p-methoxystyrene, p-phenylstyrene, p-chlorostyrene and 3,4-dichlorostyrene.

5. The toner of claim 3, wherein the acrylic ester monomer and methacrylic ester monomers are selected from the group consisting of methyl acrylate, ethyl acrylate, propyl acrylate, n-butyl acrylate, isobutyl acrylate, n-octyl acrylate, dodecyl acrylate, 2-ethylhexyl acrylate, stearyl acrylate, methyl methacrylate, ethyl methacrylate, propyl methacrylate, n-butyl methacrylate, isobutyl methacrylate, n-octyl methacrylate, dodecyl methacrylate, stearyl methacrylate, 2-chloroethyl acrylate, phenyl acrylate, methyl alpha-chloro acrylate, phenyl methacrylate, dimethylaminoethyl methacrylate, diethylaminoethyl methacrylate, 2-hydroxyethyl methacrylate, glycidyl methacrylate, bisglycidyl methacrylate, polyethyleneglycol dimethacrylate and methacryloxyethyl phosphate.

6. The toner of claim 1, wherein said another vinyl monomer is selected from the group consisting of acrylic acid, methacrylic acid, alpha-ethyl acrylic acid, crotonic acid, fumaric acid, maleic acid, citraconic acid, itaconic acid, monoacryloyloxyethylester succinate, monomethacryloyloxyethylester succinate, acrylonitrile, methacrylonitrile and acrylamide.

* * * * *